United States Patent [19]

Yoshimura

[11] Patent Number: 4,752,242

[45] Date of Patent: Jun. 21, 1988

[54] LIGHTING UNIT INSTALLING MECHANISM FOR LIGHTING PUSH BUTTON SWITCH

[75] Inventor: Simio Yoshimura, Tokyo, Japan

[73] Assignee: Sun Dengyosha Co., Ltd., Tokyo, Japan

[21] Appl. No.: 45,846

[22] Filed: Apr. 30, 1987

[30] Foreign Application Priority Data

Apr. 30, 1986 [JP] Japan ..... 61-64192

[51] Int. Cl.[4] ..... H01R 3/00

[52] U.S. Cl. ..... 439/620

[58] Field of Search ..... 439/620-622, 439/557

[56] References Cited

U.S. PATENT DOCUMENTS 4,064,426 12/1977 Tyler ..... 439/620

4,580,859 4/1986 Frano et al. ..... 439/620

*Primary Examiner*—Joseph H. McGlynn

*Attorney, Agent, or Firm*—Wenderoth, Lind & Ponack

[57] ABSTRACT

A connection mechanism for the lighting unit of a lighting push button switch: a base carrying the lighting elements is pinched between the push button and a joiner, which is provided with a cylinder on the underside, through holes are formed through the cylinder and in these holes conducting springs are inserted without the possibility of dropping downward, said cylinder is inserted into a hole formed in the housing for guiding said cylinder and to accept said push button, said base and said joiner assembled into one unit, and the lighting elements are supplied with power from external terminals through said conducting springs.

4 Claims, 4 Drawing Sheets

LIGHTING UNIT INSTALLING MECHANISM FOR LIGHTING PUSH BUTTON SWITCH

BRIEF SUMMARY OF THE INVENTION

The present invention relates to the mechanism of installing the lighting unit of a lighting push button switch to the housing, whereby said lighting unit consists of a push button, a base carrying a lighting element such as an LED, and a joiner for joining said base to said push button.

Currently, two types of lighting push button switches are in general use; one type using lamps, and the other type using LEDs. The lamp type design is inferior to the LED type design with respect to (1) the large space required by lamp sockets, (2) the shorter service life of lamps, and (3) the higher power consumption. On the other hand, the LED type design is inferior to the lamp type design in brightness. To overcome the lower brightness, the use of two or more LEDs mounted on a base was proposed such as by the Japanese Utility Model Laid-open No. 57-143524, the main object of which is to provide the method of manufacturing compact lighting push button switch incorporating a plurality of LEDs.

According to this laid-open specification 57-143524, a conducting coil spring is mounted to the housing, while a support bar inserted in this coil spring carries the LED and at the same time, is joined to the underside of the base that is integrally joined to the push button. Therefore, when replacing the LEDs, if the push button is tilted, the support bar which is joined to the base is not easily inserted to the coil spring, and if the button is forced, the support bay may get bent, or the coil spring may get deformed, to cause malfunction. For this reason, with this design, the lighting button unit can not be replaced by the purchaser, and the complete push button switch must be replaced. Furthermore, with split type lighting buttons, lighting the divided areas of the button selectively, a plurality of conductor (support) bars, the number of which corresponding to the number of the divisions of the button, are required, for example, with a 2-division lighting button, 3 terminals are required including one common earth terminal, making the correct insertion of all these conductor bars into the respective coil springs more difficult. For this reason, a split type lighting push button switch must have its own unique structure, and as a result, its manufacturing cost is high.

The first object of this present invention is to provide a lighting type push button switch with which when mounting the push button, it can be placed straightly, and with the electric connection to the base which is removably attached to said push button fully secured, so that when the lighting push button switch's lighting element becomes burnt out during use mounted on instruments, etc., the lighting elements can be replaced easily.

The second object of the present invention is to provide a structure for allowing low price manufacture of split type lighting push button switches.

To achieve the above objects, the present invention proposes a structure whereby a push button 2 is inserted into an opening in the top of the housing 1 with the freedom of vertical movement, a base 4 carrying a lighting element such as an LED 3 is joined to the bottom of said push button 2 with a removable joiner 5, a cylinder 7 to be inserted into hole 6 opened in the housing 1 is integrally formed on the bottom of said joiner 5, conducting springs 9 are undroppably inserted in each of the through holes 8 opened through said joiner 5 and said cylinder 7, with the tops of the conducting springs making contact with the contact plates 10 which are connected to the LEDs 3 installed to the bottom of said base 4, and bottoms of the conducting springs making contact with conductor bars 13 which are connected to the outside terminals 12 which are installed to the base 11 of said housing 1. To prevent the conducting springs 9 from dropping, for example, the bore of the through hole 8 may be made larger towards the top, and at the same time, the diameter of the conducting spring also larger towards the top.

Since with the present invention, the cylinder 7 formed on the underside of the joiner 5 which is removably installed at the bottom of the push button 2 to join the base 4 to the bottom of said button 2 is inserted in and positioned by the hole 6 opened in the housing 1, the push button 2 can be inserted straightly, when it is to be replaced after burning out, etc. In this case, since the cylinder 7 formed on the underside of the joiner 5 is inserted always in the same angle, the conducting bars 13 can be reliably inserted into the through hole 8 in the cylinder 7, allowing the external terminals 12 and the conducting springs 9 to be connected reliably.

Furthermore, since the conducting springs 9 are pushed up by the conductor bars 13, they make contact with the contact plate 10 at the underside of the base 4 in a constant pressure, securing reliable electric contact from the external terminals 12 to the lighting elements such as LEDs 3.

Furthermore, since the conducting spring 9 of the present invention are designed not to drop below the underside of the cylinder 7, the springs 9 are located automatically when they are inserted into the through holes 8, allowing the switch to be assembled without worry about the state of these springs 9.

BRIEF DESCRIPTION OF THE DRAWINGS

FIG. 10 is the top view of the joiner;

FIG. 11 is the top view of the housing; and

DETAILED DESCRIPTION OF THE INVENTION

Figure 1:
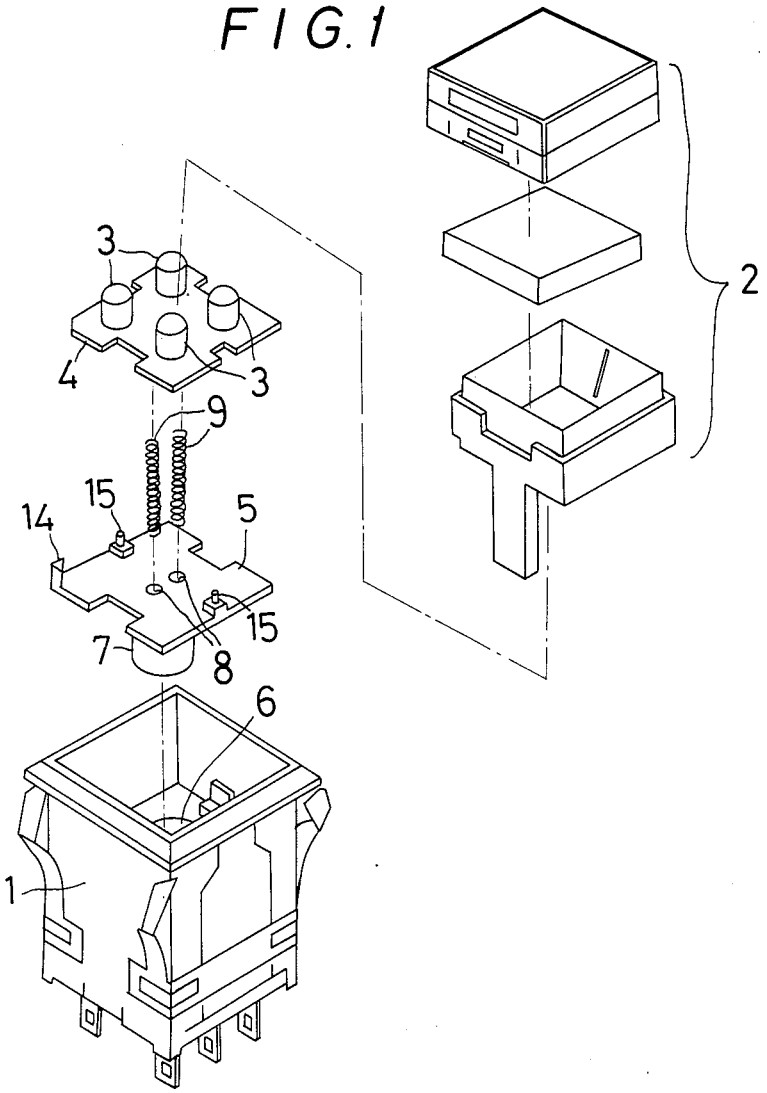
FIG. 1 is the overall disassembled oblique view.
Figure 2:
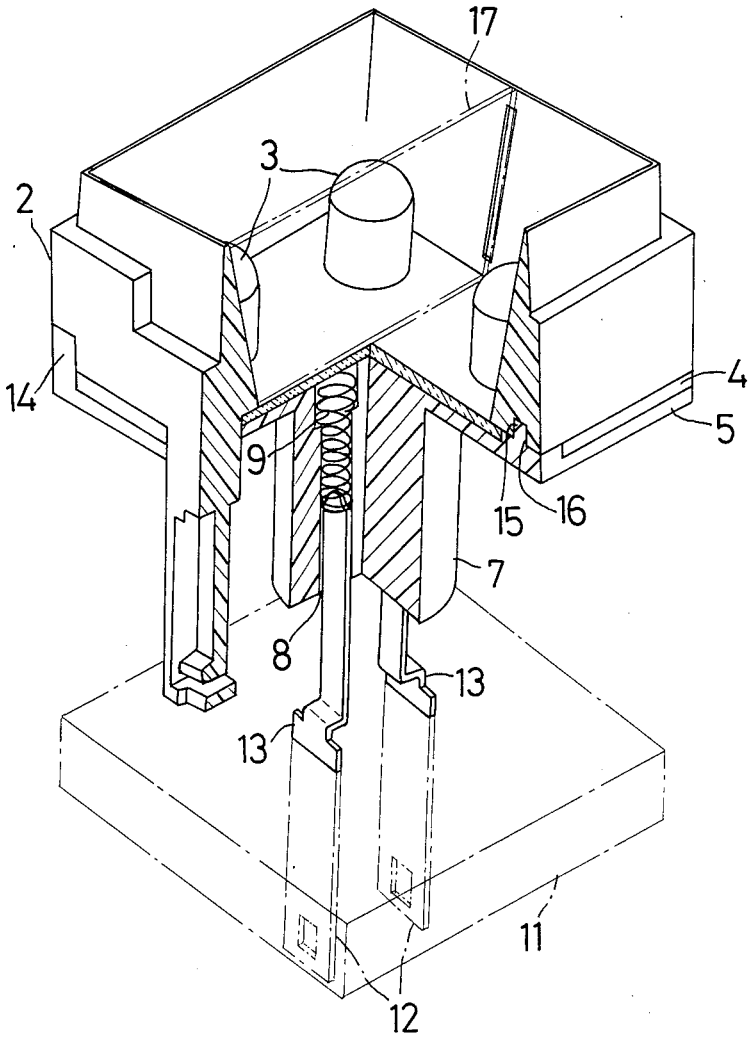
FIG. 2 is an explanatory drawing showing the connection between the through hole and the conductor bar.
Figure 3:
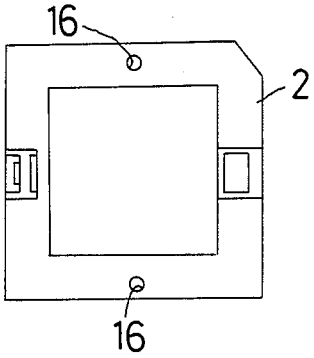
FIG. 3 is the bottom view of the push button.
Figure 4:
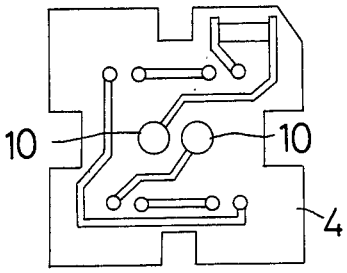
FIG. 4 is the bottom view of the base.
Figure 12:
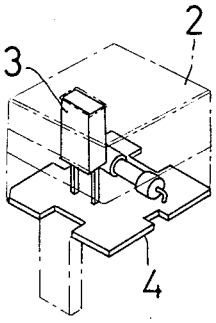
FIG. 12 is the oblique view of the base of an embodiment using one LED in the box form.

As shown in FIGS. 1 and 2, a base 4 is attached to the underside of a push button 2, which is inserted in the opening in the top of a housing 1 with vertical movement freedom, with a removable joiner 5. This base 4 is formed of ceramic or other proper material, and carries one (see FIG. 12) or several LEDs 3, firmly bonded. The circuit for lighting the LEDs 3 is formed on the base 4, and a contact plate 10 is formed at a proper position on the underside of the base 4. This contact plate is in two pieces (see FIG. 4); each connected to the + and − terminals of the LED 3 with an unsplit lighting button switch, and with a split lighting button, in three pieces; one each connected to each of the LED groups and one common terminal (see FIG. 9).

Figure 8:
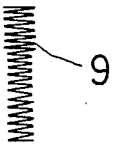
FIG. 8 is the front view of the conducting springs.

As shown in FIGS. 1, 2, 5 and 6, a cylinder 7 is formed on the underside of the joiner 5, and through holes 8 are opened from the top of the joiner 5 to the bottom of the cylinder 7, with the bores slightly larger at the ends on the side of the joiner 5. These through holes 8 are located to correspond to the positions of said contact plate pieces 10, and their top view shapes are also identical to these contact plate pieces 10. As shown in FIG. 8, the conducting springs 9 have the same sectional shapes as that of the through holes 8, with the top ends larger than the bottom ends. When these conducting springs 9 are inserted into the through holes 8 from the larger diameter opening side, and then, the joiner 5 is attached to said push button 2 pinching the base 4 in between, the conducting springs 9 are prevented from dropping out of the cylinder 7.

Figure 7:
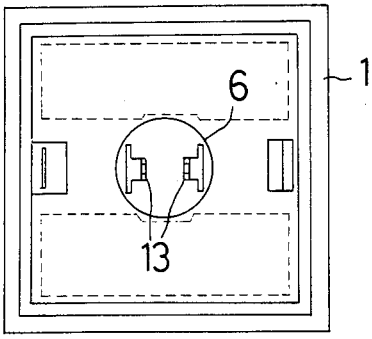
FIG. 7 is the top view of the housing.

As shown in FIGS. 1, 2 and 7, the conductor bars 13 which are vertically installed in the hole 6 formed inside the housing 1 are connected to the external terminals 12 installed to the base 11 of the housing 1. The positions of these conductor bars 13 correspond to the positions of the conducting springs 9 in the through holes 8 when the cylinder 7 is inserted to the hole 6.

Figure 5:
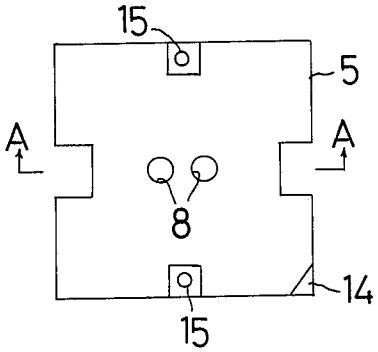
FIG. 5 is the top view of the joiner.
Figure 6:
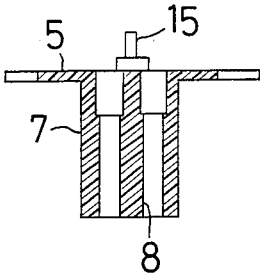
FIG. 6 is the sectional view through line A—A of FIG. 5.

As shown in FIGS. 1, 2 and 5, when the lug 15 made in the joiner 5 is inserted into the opening 16 in the push button 2 to fix the joiner 5 at the predetermined position, the projection 14 is used as a locator. The partition wall 17 installed in the lighting button 2 is shown in FIG. 2 in chain lines.

Figure 9:
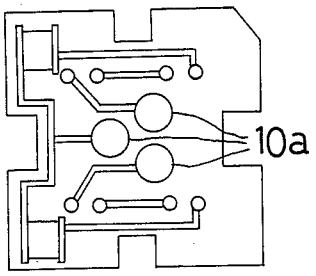
FIG. 9 through FIG. 11 show embodiments of the split lighting button switch of the present invention.
Figure 10:
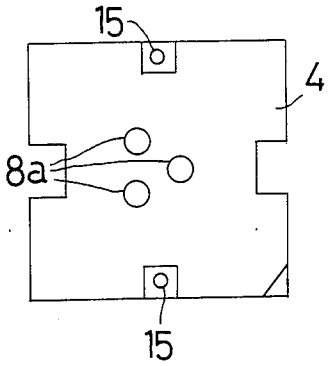
Figure 11:
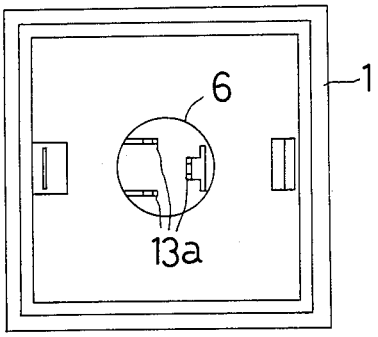

It is to be noted here that with a split lighting button, as shown in FIGS. 9 through 11, the contact plate 10*a* must be in three parts, and also the through holes 8*a* and the conductor bars 13 must be three each.

As is clear from the foregoing explanations, the present invention offers the following benefits;

(1) When replacing the LEDs, since the base is fixed to the push button 2 with the joiner, the lighting element is integrally handled conveniently with the push button.

(2) When inserting the push button into the housing, since the cylinder attached to the underside of the push button is inserted into and guided by the hole in the housing, the push button can be inserted straightly without tilting, and the conductor bars make secure contact with the conducting springs in the holes, the lighting element can be replaced easily, without the possibility of fault.

(3) Since the push button can be inserted straight without tilting, and the LED is securely connected, connection is also free from fault, even when many terminals are used to connect to the LEDs with split lighting buttons, the connection process is free from difficulty.

(4) Since the conducting springs placed in the through holes made through the joiner and the cylinder are prevented from dropping, there is no danger of their loss during their installation, allowing the lighting elements to be replaced easily even by unskilled workers.

(5) Since the structure of the present invention is simple, the products can be made compact, and manufactured in large quantity at low cost.

What is claimed is:

1. A connection mechanism for the lighting unit of a lighting push buttom switch characterised in that the push button inserted with up-down movability in the opening at the top of the housing has a joiner removably attached to its bottom, a base carrying LEDs is pinched between said push button and said joiner, said joiner is provided with an integrally formed cylinder at the bottom for insertion into a hole formed in said housing, and a plurality of through holes are opened from said joiner through to said cylnder, each of the through holes undroppably containing one conducting spring, the top ends of the conducting springs maintaining contact with the contact plate pieces of the lighting element disposed on the underside of said base, and the bottom ends thereof maintaining contact with the conductor bars which are connected to the external terminals installed to the base of the housing.

2. A connection mechanism for the lighting unit of a lighting push buttom switch according to claim 1, characterized in that said respective through holes are formed large in diameter only at the opening end on the base side, and the conducting springs inserted in each of these through holes are made in the form conforming to the shape of these through holes.

3. A connection mechanism for a lighting push button switch lighting unit according to claim 1, characterized in that said lighting elements are LEDs.

4. A lighting unit connection mechanism for lighting push button switch according to claim 1, characterized in that said lighting elements are lamps.

* * * * *